US005289977A

United States Patent [19]

Lind et al.

[11] Patent Number: 5,289,977

[45] Date of Patent: Mar. 1, 1994

[54] ELECTROSTATIC SPRAY GUN POWER SUPPLY CONNECTION

[75] Inventors: Robert J. Lind, Robbinsdale; Lawrence J. Lunzer, St. Louis Park; Stanley G. Karwoski, Oakdale, all of Minn.

[73] Assignee: Graco Inc., Minneapolis, Minn.

[21] Appl. No.: 988

[22] Filed: Jan. 6, 1993

[51] Int. Cl.[5] ..... B05B 5/02

[52] U.S. Cl. ..... 239/690; 439/934

[58] Field of Search ..... 439/181, 271, 521, 592, 439/587, 927, 933, 934; 338/114, 214, 66; 174/167; 239/708, 690, 3, 704, 691

[56] References Cited

U.S. PATENT DOCUMENTS

| | | | |
|---|---|---|---|
| 2,379,942 | 7/1945 | Webber | 439/89 |
| 3,105,218 | 9/1963 | Kozinski | 338/214 |
| 3,105,219 | 9/1963 | Kozinski | 338/214 |
| 3,167,255 | 1/1965 | Point et al. | 338/214 X |
| 3,169,883 | 2/1963 | Juvinall | 239/708 X |
| 3,599,171 | 9/1971 | Anderson | 338/66 X |
| 4,219,865 | 8/1980 | Malcolm | 361/228 |
| 4,290,091 | 9/1981 | Malcolm | 361/228 |
| 4,377,838 | 3/1983 | Levey et al. | 361/228 |
| 4,978,075 | 12/1990 | Lind et al. | 239/690 |

FOREIGN PATENT DOCUMENTS

| | | | |
|---|---|---|---|
| 2068654 | 8/1981 | United Kingdom | 439/80 |

*Primary Examiner*—Andres Kashnikow
*Assistant Examiner*—Kevin Weldon
*Attorney, Agent, or Firm*—Douglas B. Farrow

[57] ABSTRACT

An electrostatic spray gun for the application of paints and other coatings has a high voltage power supply having a contact at the front end thereof. A flange on the end of the power supply surrounds the contact and a rubber boot seal snaps over the flange. Located within the rubber boot is a conductive rubber pin which contacts with a conductor located in the barrel of the gun. Utilization of this design minimizes capacitance in the front end of the gun and also virtually eliminates air volume in the area which in turn limits the production of harmful ozone.

3 Claims, 2 Drawing Sheets

ELECTROSTATIC SPRAY GUN POWER SUPPLY CONNECTION

BACKGROUND OF THE INVENTION

Electrostatic spray guns are useful in applying coatings with a high transfer efficiency. Such spray guns usually have a high voltage power supply located within the barrel of the gun which in turn typically contacts a metallic member to transfer voltage to the needle electrode.

Such spray guns have been sold by Graco Inc., the assignee of the instant invention under the trademark PRO GUN. That product had a spring which extended from the front end of the power supply and in turn contacted a conductive member within the barrel. Such a spring has either been in contact with the member directly or is contained within a rubber boot while contacting the member.

Such a construction, to a greater or lesser extent still allows some air to exist within the barrel of the gun in the presence of high voltage electric fields. The presence of this air can lead to the production of ozone which in turn can chemically attack the barrel of the gun and lead to electrical breakdown of the barrel.

SUMMARY OF THE INVENTION

It is therefore the object of this invention to provide an improved construction which limits the capacitance and amount of air in the front end of the gun and hence the amount of ozone that will be produced.

It is further an object of this invention to provide a front end construction of the electrostatic spray gun which is reliable and easily and inexpensively manufactured.

The front of the power supply (such as that shown in the aforementioned Graco PRO GUN spray guns and more explicitly set forth in U.S. Pat. Nos. 4,219,865, 4,290,091, 4,377,838 and 4,978,075, the contents of which are incorporated by reference) is provided with a small flange at the front end thereof which surrounds a contact. A rubber boot snaps over the flange and contains therein a conductive rubber pin. The flange and boot are symmetrical in nature and do not need to be oriented in any particular direction.

Because the rubber pin completely fills the cylindrical cavity within the boot, air in the front end of the gun is almost completely eliminated as when the power supply boot and pin are placed within the gun, the boot is compressed in the mating barrel which it seals by conforming to the barrel cavity and the power supply. The small energy flow path of the conductive rubber pin minimizes volume or capacitive energy storage in the front end of the gun.

The boot and pin are also manufactured from ozone resistive material such that by eliminating the air the production of damaging ozone is almost completely eliminated.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
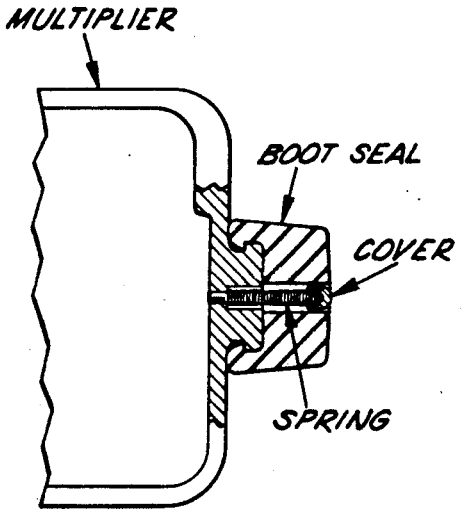
Fig 1 PRIOR ART
FIG. 1 shows the prior art device construction.

The instant invention, generally designated 10 is designed for use in a spray gun 12 having a power supply 14 located in the barrel 16 thereof. A lead 18 from multiplier 20 in power supply 14 extends to the front end of power supply 14 and is surrounded by a flange 22.

Figure 3:
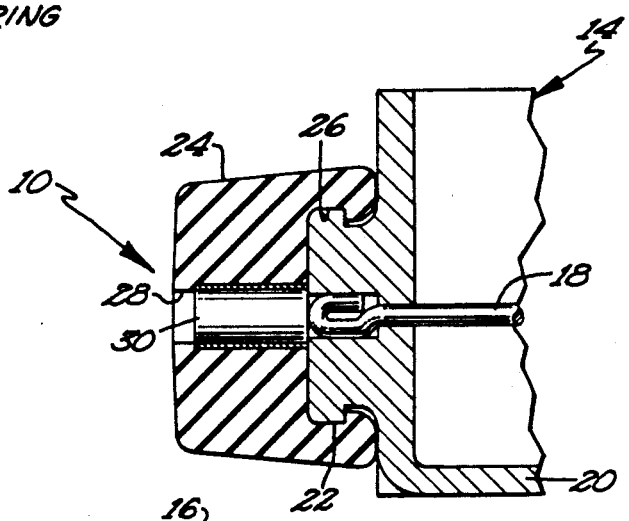
FIG. 3 shows the boot and plug of the instant invention in non-assembled condition.
Figure 4:
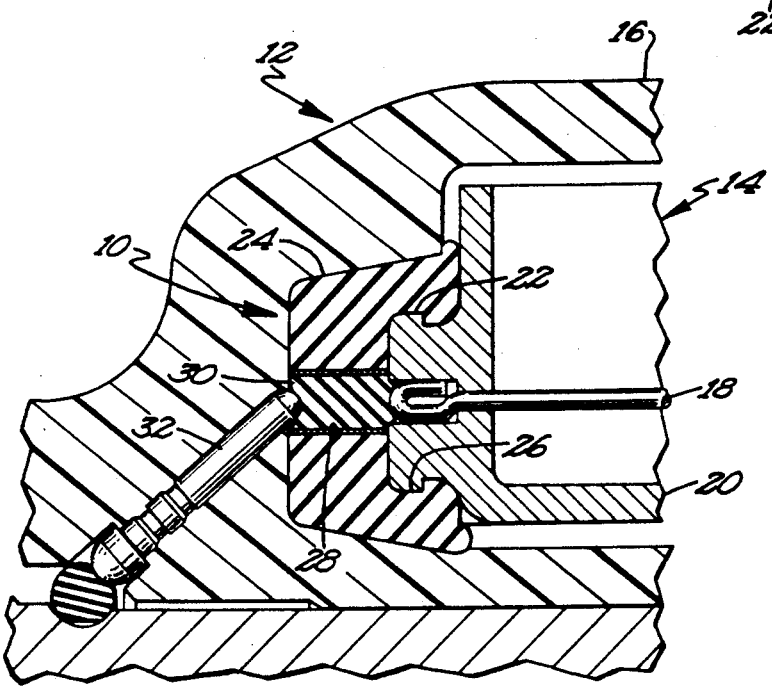
FIG. 4 shows the front end of the gun in an assembled position.
Figure 2:
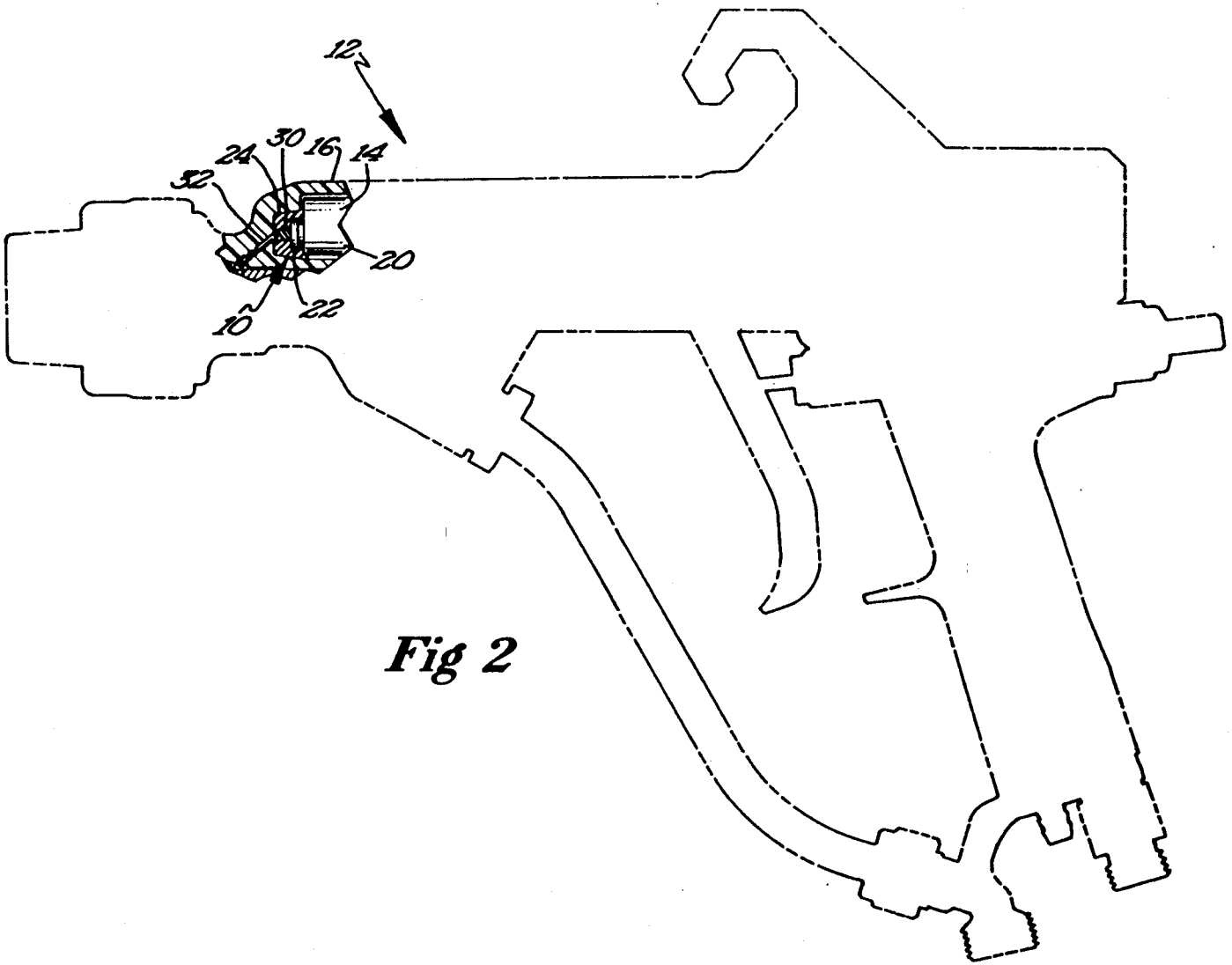
FIG. 2 shows a cross-section of a spray gun utilizing the instant invention.

Shown in FIG. 3 are the portions of the connector which are comprised generally of a boot 24 having a notch 26 in one end thereof which engages flange 22 on power supply 14 and a cylindrical interior passage 28 which contains cylindrical, flexible connector plug 30.

As can also be seen in FIG. 3, when in its free standing unassembled state, plug 30 does not extend the full length of passage 28, however when assembled, in barrel 16, boot 24 is compressed axially such that the end of conductive pin 30 is approximately even with the end of boot 24.

The end of pin 30 contacts conductive member 32 which then carries the charge to the front of the gun where it is applied to the paint or other coating material. By providing compression of boot 24, air in that area of the gun is completely forced out thereby preventing the build-up of ozone which can harm the barrel and cause electrical breakdown.

It is contemplated that various changes and modifications may be made to the power supply connection without departing from the spirit and scope of the invention as defined by the following claims.

What is claimed is:

1. In an electrostatic spray gun comprising a high voltage power supply having an output contact and a barrel cavity containing an elastomeric boot covering said contact, said boot having a generally cylindrical passage therethrough, the improvement comprising a conductive elastomeric flexible member located in and compressed so as to substantially fill said passage and said boot being compressed in said cavity to eliminate air and reduce capacitance.

2. The electrostatic spray gun of claim 1 wherein said conductive member is rubber.

3. The electrostatic spray gun of claim 2 wherein said conductive member is butyl rubber.

* * * * *